US005996256A

United States Patent [19]

Zebe, Jr.

[11] Patent Number: 5,996,256

[45] Date of Patent: Dec. 7, 1999

[54] FOOTWEAR CONSTRUCTION WITH IMPROVED CLOSURE MEANS

[76] Inventor: Charles W. Zebe, Jr., 201 Glen Brook Pl., Hightstown, N.J. 08520

[21] Appl. No.: 09/031,034

[22] Filed: Feb. 26, 1998

[51] Int. Cl.[6] ..... A43C 11/12; A43C 11/14; A43C 7/08

[52] U.S. Cl. ..... 36/50.1; 36/51; 24/712.1; 24/712.5; 24/712.6; 24/134 P

[58] Field of Search ..... 36/50.1, 51, 45, 36/52, 58.5; 24/134 P, 115 G, 712.1, 712.5, 712.6, 712.2

[56] References Cited

U.S. PATENT DOCUMENTS

| | | | |
|---|---|---|---|
| 52,951 | 3/1866 | Borchardt . | |
| 1,767,732 | 6/1930 | Breadon . | |
| 1,772,673 | 8/1930 | MacDonald . | |
| 1,823,412 | 9/1931 | Schwarze . | |
| 2,036,482 | 4/1936 | Larson . | |
| 2,845,673 | 8/1958 | Weis | 36/50.1 |
| 2,967,340 | 1/1961 | Pernecky, Jr. . | |
| 3,262,167 | 7/1966 | Martin . | |
| 3,279,015 | 10/1966 | Henning . | |
| 3,490,156 | 1/1970 | Lollmann et al. . | |
| 3,703,775 | 11/1972 | Gatti . | |
| 3,730,129 | 5/1973 | Helms . | |
| 3,744,105 | 7/1973 | Laurita . | |
| 3,765,061 | 10/1973 | Nash | 24/134 |
| 3,808,644 | 5/1974 | Schoch . | |
| 4,326,320 | 4/1982 | Riedel . | |
| 4,620,499 | 11/1986 | Siemmons | 24/134 |
| 4,640,025 | 2/1987 | DeRenzo . | |
| 4,727,627 | 3/1988 | Baggio et al. . | |
| 4,807,333 | 2/1989 | Boden . | |
| 4,899,423 | 2/1990 | Randall | 24/134 |
| 4,907,352 | 3/1990 | Ginsberg . | |
| 4,956,897 | 9/1990 | Speedie | 24/134 |
| 5,157,813 | 10/1992 | Carroll . | |
| 5,177,882 | 1/1993 | Berger . | |
| 5,181,331 | 1/1993 | Berger . | |
| 5,205,055 | 4/1993 | Harrell . | |
| 5,333,398 | 8/1994 | Seo . | |
| 5,335,401 | 8/1994 | Hanson . | |
| 5,349,764 | 9/1994 | Posner . | |
| 5,537,763 | 7/1996 | Donnadieu et al. . | |
| 5,640,785 | 6/1997 | Egelja . | |
| 5,755,044 | 5/1998 | Veylupek . | |

FOREIGN PATENT DOCUMENTS

| | | | |
|---|---|---|---|
| 4010 | 4/1895 | United Kingdom | 24/712.6 |

*Primary Examiner*—Paul T. Sewell
*Assistant Examiner*—Anthony Stashick
*Attorney, Agent, or Firm*—Sperry, Zoda & Kane

[57] ABSTRACT

A footwear device with an improved means of closing thereof utilizing a lacing means extending through eyelets or hooks and being fixedly secured in a tightened position extending therethrough by being positioned through a cam cleat. Preferably the configuration of the cam cleat includes two individual cam cleating devices one on each opposite side of the ankle of the wearer which each may include a guide ring for facilitating guiding and retaining of the shoelace extending therethrough. It is preferred that the shoelace include a plurality of slits defined therein which are adapted to be positioned extending over and retained by studs mounted in spaced relation with respect to one another adjacent to each of the camming cleats to neatly and in an orderly manner prevent the laces from becoming dislodged from the cam cleat as well as to prevent them from being undesirably loosened. With this configuration the laces will be neatly retained extending along the upper surface of the upper member of the shoe configuration and will not be hanging loosely as with other conventional lace tieing configurations such as tieing the laces into a bow.

21 Claims, 2 Drawing Sheets

FOOTWEAR CONSTRUCTION WITH IMPROVED CLOSURE MEANS

BACKGROUND OF THE INVENTION

1. Field of the Invention

The present invention deals with the field of shoewear generally and preferably sport shoewear and shoewear for children, juveniles and toddlers and young people generally. It is preferable that the tightening mechanism for such shoes be secure and adjustable and easy to both secure and release. Especially with younger children and disabled persons, the tieing of conventional bows is a learned skill which is a common problem experienced by parents and teachers. The present invention makes use of a cam cleat configuration and optional stud and mating slotted engagement member and grip enhancing member for providing a novel improved design for tightening shoes around the foot of a wearer.

2. Description of the Prior Art

Numerous prior art devices have been patented for the purpose of providing different means for configuring shoes and sport shoes and for tightening and lacing thereof such as shown in U.S. Pat. No. 3,262,167 patented Jul. 26, 1966 to H. Martin on a "Closure For Footwear Having Interconnected Rotatable Members"; and U.S. Pat. No. 3,279,015 patented Oct. 18, 1966 to L. M. Henning and assigned to Byron V. Curry, William J. Gribble and N. S. Henning on a "Shoelace Apparatus"; and U.S. Pat. No. 3,425,408 patented Feb. 4, 1969 to M. Vinet and assigned to Vapor Corporation on a "Track Switch Heater"; and U.S. Pat. No. 3,490,156 patented Jan. 20, 1970 to P. Lollmann et al and assigned to Rieker & Co. on "Sports Footwear"; and U.S. Pat. No. 3,703,775 patented Nov. 28, 1972 to J. Gatti on "Football Boots"; and U.S. Pat. No. 3,808,644 patented May 7, 1974 to R. Schoch and assigned to Weinmann Aktiengesellschaft on a "Closure Device For Shoes, Particularly For Ski Shoes"; and U.S. Pat. No. 4,326,320 patented Apr. 27, 1982 to T. Riedel and assigned to Sesamat Anstalt on a "Lever-Operable Fastener For A Shoe"; and U.S. Pat. No. 4,640,025 patented Feb. 3, 1987 to J. DeRenzo on a "Figure Eight Shoe Tie System"; and U.S. Pat. No. 4,907,352 patented Mar. 13, 1990 to J. Ginsberg on a "Shoe Lace Replacing And Shoe Fastening Device"; and U.S. Pat. No. 5,177,882 patented Jan. 12, 1993 to C. Berger and assigned to PUMA AG Rudolf Dassler Sport on a "Shoe With A Central Fastener"; and U.S. Pat. No. 5,181,331 patented Jan. 26, 1993 to C. Berger and assigned to Puma Rudolf Dassler Sport on a "Shoe With Flexible Upper Material Provided With A Closing Device"; and U.S. Pat. No. 5,205,055 patented Apr. 27, 1993 to A. Harrell on a "Pneumatic Shoe Lacing Apparatus"; and U.S. Pat. No. 5,333,398 patented Aug. 2, 1994 to Y. Seo on a "Lace Fastening Cleat And Shoe"; and U.S. Pat. No. 5,349,764 patented Sep. 27, 1994 to S. Posner and assigned to Dan Lynn Industries, Inc. on a "Shoe Securement Apparatus"; and U.S. Pat. No. 5,537,763 patented Jul. 23, 1996 to T. Donnadieu et al and assigned to Salomon S. A. on a "Boot With Tightening System With Memorization Of Tension"; and U.S. Pat. No. 5,640,785 patented Jun. 24, 1997 to S. Egelja and assigned to Items International, Inc. on "Resilient Loops And Mating Hooks For Securing Footwear To A Foot".

SUMMARY OF THE INVENTION

The present invention provides a unique footwear construction with an improved means for closure thereof and for selective tightening thereof to aid in attachment to the foot of a wearer tightly as desired.

The construction includes a footwear sole adapted to extend below the foot of a wearer as well as a footwear upper member attached to the footwear sole and extending upwardly therefrom around the wearer's foot. The footwear upper defines preferably a foot opening therein which allows easy entry and exit of the foot of a wearer therewithin. The footwear upper also preferably defines an elongated lacing gap adjacent the footwear opening preferably and extending therealong to facilitate this entry and exit of the wearer's foot with respect to the footwear upper member.

The footwear upper member includes a first opening edge area extending along one side of the elongated lacing gap and it also defines a plurality of first lacing apertures extending therealong preferably. These lacing apertures could also be lacing hooks in an alternative configuration. The footwear upper also includes a second opening edge area extending along the opposite side of the elongated lacing gap where it preferably also defines a plurality of second lacing apertures or eyelets therealong. These eyelets can be replaced by hooks which also provide a convenient means for securing of a lacing means with respect to both the first opening edge area and the second opening edge area of the foot upper. With this configuration the first opening edge area and the second opening edge area define the elongated lacing gap therebetween. The first opening edge area and the second opening edge area are preferably movable together toward one another to selectively tighten the elongated lacing gap responsive to tightening and securement of the footwear lacing within the cam cleat of the lacing securement means.

The footwear construction also preferably includes a footwear lacing member secured to the footwear upper along the elongated lacing gap by extending thereof through the lacing apertures or around the lacing hooks for tightening thereof and for selectively securing the footwear upper about the foot of a wearer. The footwear lacing preferably includes a longitudinal lacing member including a first lacing end and a second lacing end. Preferably this footwear lacing member is circular in cross section and is longitudinally resiliently extensible to facilitate selective securement thereof as desired. In the preferred configuration the lacing can be of a rubber type resilient material to facilitate longitudinal extendibility thereof. The footwear lacing device also can include a plurality of first securement slots defined therein adjacent the first lacing end. Also the footwear lacing means can further define a plurality of second securement slots therein adjacent the second lacing end.

The footwear construction further includes a lacing securement apparatus attached to the footwear upper adjacent to the elongated lacing gap for receiving and securing the footwear lacing in a tightened position for retaining the elongated lacing gap selectively retained. The lacing securement means includes at least one cam cleat means including a pair of pivotal members being relatively pivotally movable and positioned adjacently and adapted to selectively grip and retain said footwear lacing extending therebetween for selectively tightening thereof across the elongated lacing gap to retain the footwear about the foot of the wearer.

These cam cleat means preferably include a first cam cleat mounted to the footwear upper along the elongated lacing gap for receiving the first lacing end of the longitudinal lacing member extending therethrough for selective securement therebetween.

Also preferably the cam cleat configuration includes a second cam cleat mounted to the footwear upper spatially disposed from the first cam cleat and along the elongated lacing gap means for receiving the second lacing end of the longitudinal lacing member extending therethrough for selective securement therewithin. The first cam cleat and the second cam cleat are preferably mounted upon the footwear upper with the elongated lacing gap positioned therebetween to facilitate tightening thereof responsive to securement of the first lacing end with respect to the first cam cleat and to securement of the second lacing end with respect to the second cam cleat.

In the preferred configuration the present apparatus includes a stud means for selective securement of the footwear lacing with respect to the footwear upper. Preferably the configuration of the stud means includes a plurality of first studs fixedly secured to the footwear upper and extending outwardly therefrom adjacent the first cam cleat and adapted to be positioned extending into the first securement slots defined near the first lacing end of the footwear lacing means positioned extending through and retaining within the first cam cleat. Similarly the stud means preferably includes a plurality of second studs fixedly secured to the footwear upper and extending outwardly therefrom adjacent to the cam cleat and adapted to be positioned extending into the second securement slots defined in the second lacing end of the footwear lacing positioned extending through and retained within the second cam cleat.

It is an object of the present invention to provide a footwear construction with improved closure means for selectively tightening thereof for facilitating attachment about the foot of a wearer wherein tightening of the shoelace is simple and quick.

It is an object of the present invention to provide a footwear construction with improved closure means for selectively tightening thereof for facilitating attachment about the foot of a wearer wherein tightening of a shoelace is performed by an apparatus which has a minimum number of moving parts.

It is an object of the present invention to provide a footwear construction with improved closure means for selectively tightening thereof for facilitating attachment about the foot of a wearer wherein loose shoelaces such as when the laces are tied into a bow are eliminated.

It is an object of the present invention to provide a footwear construction with improved closure means for selectively tightening thereof for facilitating attachment about the foot of a wearer which is particularly useful for handicapped persons to facilitate tightening and removal of footwear.

It is an object of the present invention to provide a footwear construction with improved closure means for selectively tightening thereof for facilitating attachment about the foot of a wearer which is particularly helpful to persons afflicted with arthritis and other physically debilitating illnesses by great easing both tightening and removal of footwear.

It is an object of the present invention to provide a footwear construction with improved closure means for selectively tightening thereof for facilitating attachment about the foot of a wearer wherein shoelaces are maintained in a biased orientation through a cam cleat and are held firmly against the surface of a shoe upper while the shoes are worn and used.

It is an object of the present invention to provide a footwear construction with improved closure means for selectively tightening thereof for facilitating attachment about the foot of a wearer wherein cost of manufacture is minimized.

It is an object of the present invention to provide a footwear construction with improved closure means for selectively tightening thereof for facilitating attachment about the foot of a wearer wherein use by young children who have difficulty tieing shoelaces is made possible.

It is an object of the present invention to provide a footwear construction with improved closure means for selectively tightening thereof for facilitating attachment about the foot of a wearer wherein safety is an important consideration and loose shoelaces could lead to injury to the wearer.

It is an object of the present invention to provide a footwear construction with improved closure means for selectively tightening thereof for facilitating attachment about the foot of a wearer which prevent laces on any type of shoe from becoming loose which could cause the user to step on, trip over or entangle such loose laces which could seriously injury the wearer.

It is an object of the present invention to provide a footwear construction with improved closure means for selectively tightening thereof for facilitating attachment about the foot of a wearer wherein tightening of a shoe by extending of the shoelace through eyelet openings or hooks are both possible with the same shoelace tightening construction.

It is an object of the present invention to provide a footwear construction with improved closure means for selectively tightening thereof for facilitating attachment about the foot of a wearer wherein a "bowless" shoelace tightening mechanism is made simple and inexpensively.

It is an object of the present invention to provide a footwear construction with improved closure means for selectively tightening thereof for facilitating attachment about the foot of a wearer wherein difficulties experienced with shoelaces repeatedly becoming untied are obviated.

It is an object of the present invention to provide a footwear construction with improved closure means for selectively tightening thereof for facilitating attachment about the foot of a wearer wherein usage with various types and materials of shoelaces are made possible.

It is an object of the present invention to provide a footwear construction with improved closure means for selectively tightening thereof for facilitating attachment about the foot of a wearer wherein accurate control of the tension on shoelaces is significantly enhanced.

It is an object of the present invention to provide a footwear construction with improved closure means for selectively tightening thereof for facilitating attachment about the foot of a wearer wherein use by handicapped persons is particularly facilitated.

It is an object of the present invention to provide a footwear construction with improved closure means for selectively tightening thereof for facilitating attachment about the foot of a wearer wherein ease of use for persons with debilitating conditions such as arthritis is significantly enhanced.

It is an object of the present invention to provide a footwear construction with improved closure means for selectively tightening thereof for facilitating attachment about the foot of a wearer wherein unwanted loosening of shoelaces can be prevented by a cam cleat and stud means which both provide engagement with respect to a lacing member.

BRIEF DESCRIPTION OF THE DRAWINGS

While the invention is particularly pointed out and distinctly claimed in the concluding portions herein, a preferred embodiment is set forth in the following detailed description which may be best understood when read in connection with the accompanying drawings, in which:

DETAILED DESCRIPTION OF THE PREFERRED EMBODIMENT

Figure 1:
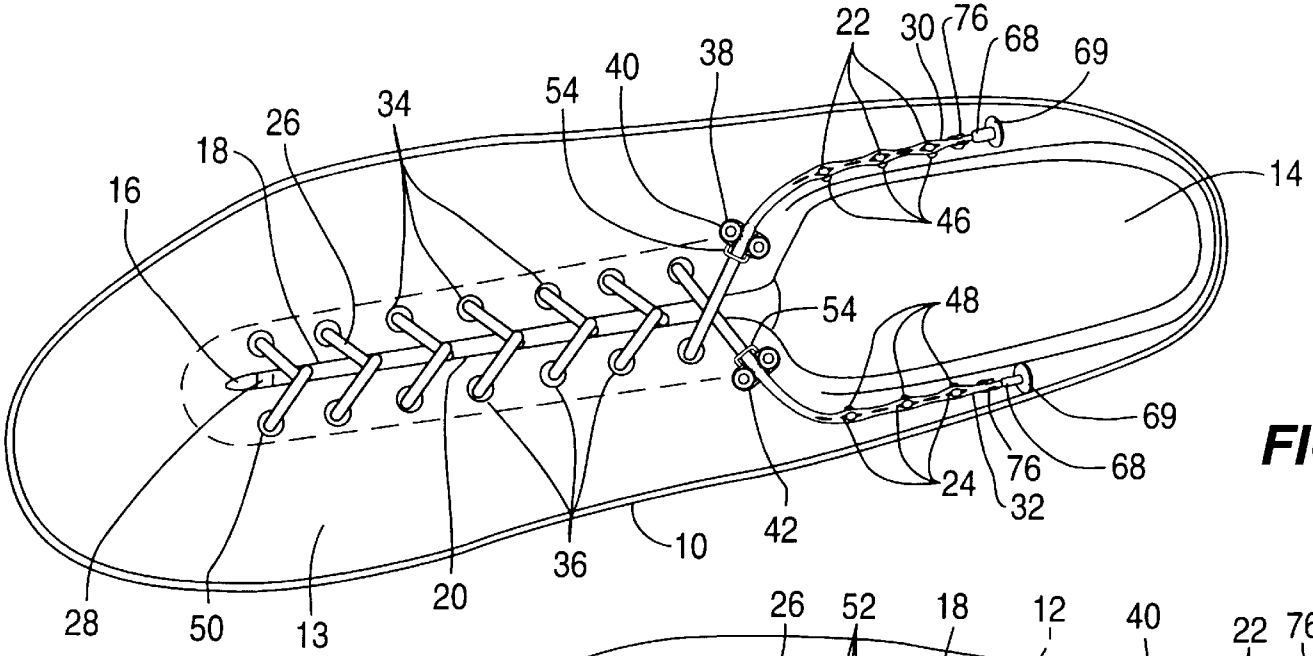
FIG. 1 is a top perspective illustration of an embodiment of the footwear construction of the present invention showing the improved closure means.

With most footwear constructions the manner of securement of the lacing means for tightening thereof is by the forming of a bow. The present invention provides a means for having an improved more controllable tensioning of the force upon lacing during tightening of footwear around the wearer's foot 12. The improved footwear construction of the present invention includes a footwear sole 10 with a footwear upper 13 extending upwardly therefrom capable of surrounding engagement about the wearer's foot 12. The footwear upper 13 preferably defines a foot opening 14 to facilitate placement of the wearer's foot 12 therein and an elongated lacing gap 16 to allow an increase in the size of the foot opening 14 during entry or exit of the wearer's foot 12 therefrom and to allow tightening of this gap 16 to firmly hold the wearer's foot 12 therein. The foot opening 14 is preferably defined by a first opening edge area 18 defined on the footwear upper 13 and a second opening edge area 20 also defined on the footwear upper member 13. These opening edge areas are movable toward one another for tightening of the footwear construction and for moving apart in order to open the footwear construction and facilitate entry and exit of the wearer's foot from within the shoe.

In the preferred configuration the first opening edge area 18 will define a plurality of first lacing apertures 34 therein. In a similar manner the second opening edge 20 will preferably define a plurality of second lacing apertures 36 therein. These lacing apertures will facilitate loosening and tightening of the elongated lacing gap 16.

A footwear lacing member 26 will preferably extend through the first lacing apertures 34 and the second lacing apertures 36. This footwear lacing 26 preferably comprises a longitudinal lacing member 28 with a first lacing end 30 and a second lacing end 32 oppositely located thereon.

The improved configuration of the present invention is in the novel lacing securement means 38 defined in the footwear construction of the present invention. This lacing securement means 38 preferably includes a first cam cleat 40 positioned adjacent the foot opening 14 near the uppermost of the first lacing apertures 34. With this positioning the first cam cleat 40 is adapted to receive the first lacing end 30 extending thereinto for securement therewithin. In a similar manner a second cam cleat 42 is preferably positioned adjacent the foot opening 14 of the footwear upper 13 adjacent the uppermost of the second lacing apertures 36 for receiving of the second lacing end 32 of the longitudinal lacing member 28 extending therewithin for securement therein.

Figure 5:
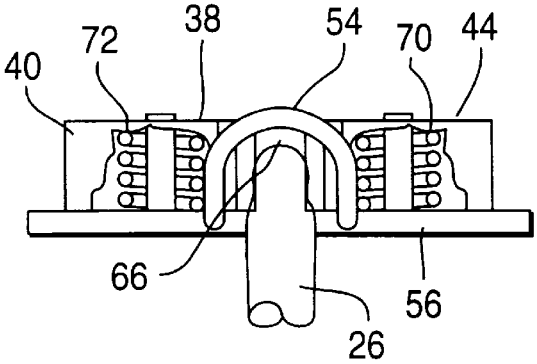
FIG. 5 is a front plan view of a cam cleat of the present invention showing a lacing means passing through a guide means and through the cam cleat itself.
Figure 6:
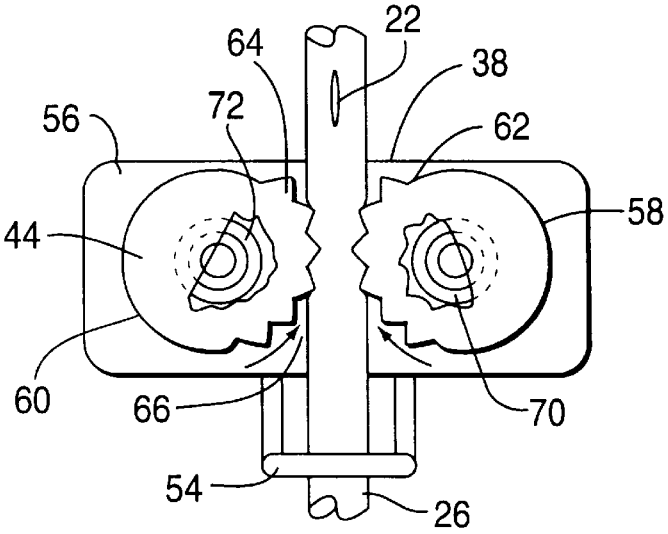
FIG. 6 is a top plan view of the embodiment shown in FIG. 5.

Each of the cam cleats 40 and 42 preferably is formed with a cleat base 56 and each includes a first cam member 58 and a second cam member 60 both rotatably mounted with respect to the cleat base 56. The first cam member 58 is biased to urge it to rotate in a clockwise direction and a second cam member 60 is biased to urge movement in a counter-clockwise direction such that the first camming surface 62 of first cam member 58 and a second camming surface 64 of the second cam member 60 will be positioned adjacent to one another. These adjacently positioned camming surfaces 62 and 64 will define therebetween a lacing receiving slot 66 which is adapted to receive and selectively grasp and retain a longitudinal lacing member 28 extending therethrough. All configurations of such cam cleats 40 and 42 include generic pivotal members 44 which are shown as the first cam member 58 and the second cam member 60. These pivotal members pivot toward one another in such a manner as to define the lacing receiving slots 66 as defined thereabove. The first cam member 58 is biased to urge it to rotate in a clockwise direction preferably by the inclusion of a first spring means 70 as shown best in FIG. 5. Similarly the second cam member 60 is biased to urge movement in a counterclockwise direction by a second spring means 72 as also shown in FIG. 5.

Figure 3:
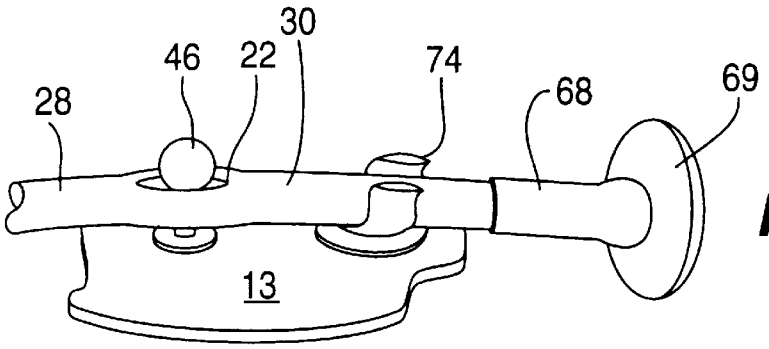
FIG. 3 is a side plan view of engagement between a lacing member and a stud mounted on a shoe upper showing the metallic tip and the clip member***.
Figure 4:
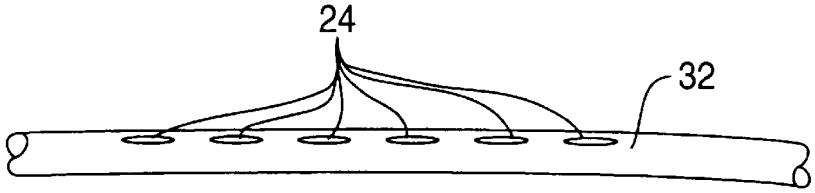
FIG. 4 is an illustration of a lacing means of the present invention showing the securement slots therein.
Figure 7:
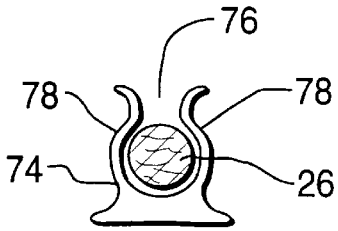
FIG. 7 is a side cross-sectional view of the clip member of the present invention shown gripping a lace.

To further facilitate retaining of the laces 26 after shoe securement, a clip member 74 may be included as shown best in FIGS. 3,4 and 7. This clip will preferably be made of a flexibly resilient material and will include two resilient side members 78 to enhance detachable gripping of the laces 26. Side members 78 will preferably be spaced apart to as to define an open top area 76 therebetween to allow entry of the laces 26 into the area between the flexibly resilient side members 78 to facilitate gripping thereof.

Figure 2:
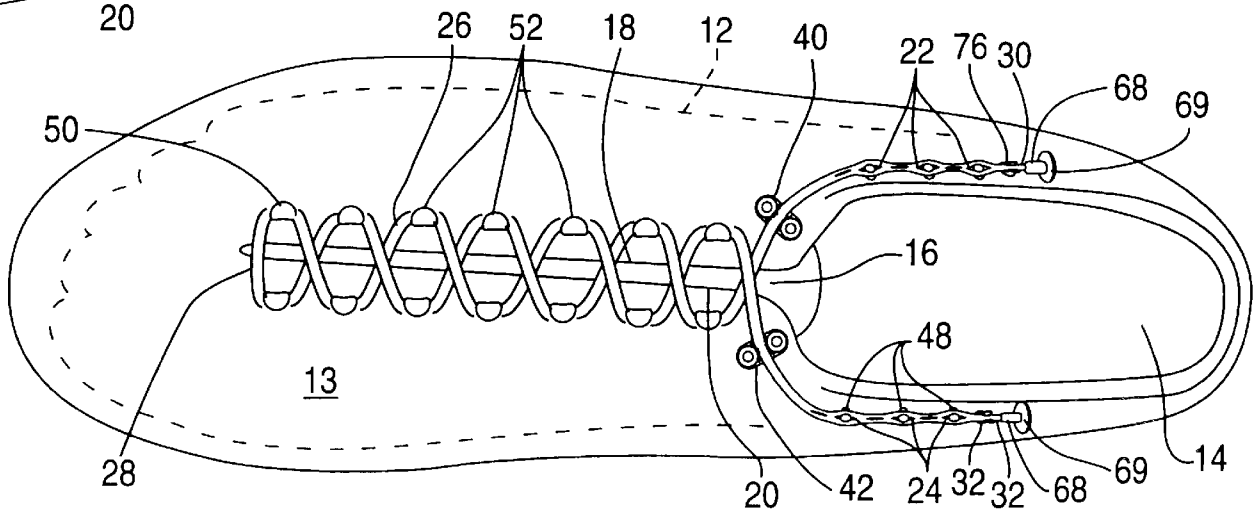
FIG. 2 is a top plan view of an alternative configuration of the footwear construction of the present invention with improved closure means showing the use of hooks for closing of the tightening gap.

In an alternative configuration the lacing securement means 38 can utilize an upper securement member 50 of an alternative configuration such as a plurality of lacing hooks 52. These lacing hooks 52 as shown in FIG. 2 can be used in placement of or in combination with the first and second lacing apertures 34 and 36 defined above.

In order to further facilitate retaining and securement of the footwear lacing 26 within the lacing receiving slot 66 of the first and second cam members 58 and 60, a guide ring 54 may preferably be included. Such a guiding loop or ring is sometimes referenced as a fairlead. This guide ring is adapted to receive the longitudinally extending lacing member 28 extending therethrough and guided toward the lacing receiving slot 66 for gripping thereof. It also facilitates retaining of the lacing within the lacing receiving slot 66 after securement thereof.

To further facilitate securement of the footwear lacing 26 with respect to the footwear upper 13 a plurality of stud members fixedly secured to the footwear upper 13 to extend outwardly therefrom. These stud members preferably include a plurality of first stud members 46 positioned in spaced relation with respect to one another adjacent to the first cam cleat 40. With this configuration the footwear lacing 26 will preferably define a plurality of first securement slots 22 positioned longitudinally therein in spaced relation with respect to one another and capable of registration with the lateral spacing between the individual first stud members 46. With this configuration once the footwear lacing 26 has been resiliently retained within the first cam cleat 40 the first securement slots 22 therein can individually be placed on each one of the first stud members 46 such as to extend therearound and be in securement therewith. In this manner the first lacing end 30 of the longitudinal lacing member 28 will be firmly and in a neat manner retained with respect to the footwear upper 13.

In a similar manner the stud configuration of the retaining apparatus of the present invention can include a plurality of second stud members 48 spatially disposed from one another and positioned adjacent to the second cam cleat 42. With the second lacing end 32 of the longitudinal lacing member 28 extending through the second cam cleat 42 and retained within the receiving slot thereof the second lacing end 32 will be positioned adjacent to these second stud members 48. Second lacing end 32 also preferably defines a plurality of second securement slots 24 therein adapted to engage and surround and be retained by the second stud members 48 for neatly retaining the second lacing end 32 along the outer surface of the footwear upper 13.

Also in the preferred configuration the first lacing end 30 and the second lacing end 32 will include a metallic tip means 68 which can be decorative. A gripping means 69 can also be included instead of or in addition to the tip means 68. This gripping member 69 may comprises a detachable flange member as shown in FIGS. 1,2 and 3 at both ends of the lacing member for facilitating gripping of the first lacing end 30 and the second lacing end 32 and pulling thereof through the receiving slots defined in the first cam cleat 40 and the second cam cleat 42 in such a manner as to accurately control the tension. Such gripping enhancing members can be particularly useful with footwear lacing 26 which is longitudinally extensible however such grip aid means is also useful with lacing made of any material in order to provide firm securement thereof within the cam cleat members and to pull the lacing to a point sufficient to cause accurate alignment of the lacing apertures with the securement studs. As shown in the drawings the gripping means 69 comprises a disc shaped member detachably securable to both ends of the footwear lacing 26.

Also it should be preferred that the footwear lacing 26 of the present invention can be longitudinally extensible such as being made of a rubber-type material or similar to a very small bungee cord construction. With these structures the user after lacing of the shoe can hold the first lacing end 30 and the second lacing end 32 and pull both ends of the footwear lacing 26 through the respective first and second cam cleats 40 and 42 in such a manner as to longitudinally extend the lacing itself and thereby accurately and firmly control the amount of tightening being exerted upon the longitudinal lacing member 28. Inclusion of a gripping means 69 on each end of the footwear lacing has been found to be particularly advantageous with such longitudinally extensible footwear lacing 26.

It should be appreciated that the use of the cam cleats 40 and 42 of the present invention prevents the necessity for tieing bows or other complicated or difficult to master tightening procedures commonly presented in prior art shoe devices. As such, the use of sport shoes or children's shoes with these miniaturized cam cleat securement means are a distinct advantage when quick, convenient and reliable tightening of shoes about the feet of a wearer is desired. It should be appreciated that the cam cleats of the present invention can be utilized with any different type of footwear sole and upper configuration as long as one or more lacing members are utilized which are capable of passing through a cam cleat tightening apparatus. All of these designs are currently being contemplated under the concepts of the present invention.

While particular embodiments of this invention have been shown in the drawings and described above, it will be apparent, that many changes may be made in the form, arrangement and positioning of the various elements of the combination. In consideration thereof it should be understood that preferred embodiments of this invention disclosed herein are intended to be illustrative only and not intended to limit the scope of the invention.

I claim:

1. A footwear construction with improved closure means for selective tightening thereof for facilitating attachment about the foot of a wearer, said footwear means comprising:

A. a footwear sole means adapted to extend below the foot of a wearer;

B. a footwear upper means attached to said footwear sole means and extending upwardly therefrom around the foot of the wearer, said footwear upper means defining a foot opening means therein to allow entry and exit of the foot of a wearer therewithin, said footwear upper means also defining an elongated lacing gap means extending therealong and adjacent the foot opening defined therein to facilitate entry and exit of the foot of a wearer within the footwear upper means;

C. a footwear lacing means secured to said footwear upper means along said elongated lacing gap means for tightening thereof for selectively securing the footwear upper means about the foot of a wearer; and D. a lacing securement means attached to said footwear upper means adjacent said elongated lacing gap means thereof for receiving and securing said footwear lacing means in a tightened position for retaining said elongated lacing gap means selectively retained, said lacing securement means including at least one cam cleat means including a pair of pivotal members being relatively pivotally movable and positioned adjacently and adapted to selectively grip and retain said footwear lacing means extending therebetween for selectively tightening thereof across said elongated lacing gap means to retain the footwear means about the foot of a wearer; and E. a guide ring means positioned between said cam cleat means of said lacing securement means and said elongated lacing gap means, said guide ring means being adapted to receive said footwear lacing means extending therethrough to facilitate guiding and retaining of said footwear lacing means within said cam cleat means.

2. A footwear construction with improved closure means for selective tightening thereof for facilitating attachment about the foot of a wearer as defined in claim 1 wherein said footwear lacing means comprises a longitudinal lacing member including a first lacing end and a second lacing end.

3. A footwear construction with improved closure means for selective tightening thereof for facilitating attachment about the foot of a wearer as defined in claim 2 wherein said lacing securement means includes:

A. a first cam cleat means mounted to said footwear upper means along said elongated lacing gap means for receiving said first lacing end of said longitudinal lacing member extending therethrough for selective securement therewithin; and B. a second cam cleat means mounted to said footwear upper means spatially disposed from said first cam cleat means and along said elongated lacing gap means for receiving said second lacing end of said longitudinal lacing member extending therethrough for selective securement therewithin.

4. A footwear construction with improved closure means for selective tightening thereof for facilitating attachment about the foot of a wearer as defined in claim 3 wherein said first cam cleat means and said second cam cleat means are mounted upon said footwear upper means with said elongated lacing gap means positioned therebetween to facilitate tightening thereof responsive to securement of said first lacing end within said first cam cleat means and said second lacing end within said second cam cleat means.

5. A footwear construction with improved closure means for selective tightening thereof for facilitating attachment about the foot of a wearer as defined in claim 1 wherein said footwear lacing means is longitudinally resiliently extensible to facilitate selective securement thereof within said cam cleat means of said lacing securement means.

6. A footwear construction with improved closure means for selective tightening thereof for facilitating attachment about the foot of a wearer as defined in claim 1 wherein said lacing securement means includes a plurality of upper securement members positioned on said footwear upper means immediately adjacent and along said elongated lacing gap means and being selectively securable with respect to said footwear lacing means for tightening of said elongated lacing gap means responsive to securement of said footwear lacing means with respect to said cam cleat means.

7. A footwear construction with improved closure means for selective tightening thereof for facilitating attachment about the foot of a wearer as defined in claim 6 wherein said upper securement members comprise lacing apertures defined in said footwear upper means along and adjacent said elongated lacing gap means.

8. A footwear construction with improved closure means for selective tightening thereof for facilitating attachment about the foot of a wearer as defined in claim 6 wherein said upper securement members comprise lacing hooks secured to said footwear upper means along and adjacent said elongated lacing gap means.

9. A footwear construction with improved closure means for selective tightening thereof for facilitating attachment about the foot of a wearer as defined in claim 1 wherein said footwear upper means includes:

A. a first opening edge area extending along one side of said elongated lacing gap means; and B. a second opening edge area extending along the opposite side of said elongated lacing gap means, said first opening edge area and said second opening edge area defining said elongated lacing gap means therebetween, said first opening edge area and said second opening edge area being movable together to selectively tighten said elongated lacing gap means responsive to tightening securement of said footwear lacing means within said cam cleat means of said lacing securement means.

10. A footwear construction with improved closure means for selective tightening thereof for facilitating attachment about the foot of a wearer as defined in claim 1 wherein said footwear lacing means includes a securement slot means defined longitudinally therein and wherein said footwear construction further comprises a stud means secured to said footwear upper means and extending outwardly therefrom, said footwear lacing means being further attachable with respect to said footwear upper means by positioning said securement slot means in surrounding selective engagement around said stud means.

11. A footwear construction with improved closure means for selective tightening thereof for facilitating attachment about the foot of a wearer as defined in claim 10 wherein said securement slot means includes a plurality of securement slots defined along said footwear lacing means and wherein said stud means includes a plurality of stud members mounted on said footwear upper means with said securement slot means being selectively engageable therearound to retain said footwear lacing means with respect to said footwear upper means.

12. A footwear construction with improved closure means for selective tightening thereof for facilitating attachment about the foot of a wearer as defined in claim 10 wherein said stud means are positioned adjacent to said cam cleat means upon said footwear upper means.

13. A footwear construction with improved closure means for selective tightening thereof for facilitating attachment about the foot of a wearer as defined in claim 10 wherein said stud members are mounted upon said footwear upper means spatially disposed from said elongated lacing gap means thereof with said cam cleat means positioned therebetween.

14. A footwear construction with improved closure means for selective tightening thereof for facilitating attachment about the foot of a wearer as defined in claim 1 wherein said cam cleat means comprises:

A. a cleat base means secured to said footwear upper means;

B. a first cam member pivotally movably mounted to said cleat base means and being resiliently biased for clockwise rotation thereof with respect to said cleat base means, said first cam member including a first camming surface adapted to abut and engage said footwear lacing means;

C. a second cam member pivotally movably mounted to said cleat base means and being resiliently biased for counter-clockwise rotation thereof with respect to said cleat base means, said second cam member including a second camming surface adapted to abut and engage said footwear lacing means, said second cam member being positioned adjacent said first cam member with said first camming surface and said second camming surface defining a lacing receiving slot therebetween adapted to receive said footwear lacing means for selective securement therewithin.

15. A footwear construction with improved closure means for selective tightening thereof for facilitating attachment about the foot of a wearer as defined in claim 1 wherein said footwear lacing means are made of a rubber material which is longitudinally extensible to facilitate gripping and tightening thereof within said cam cleat means.

16. A footwear construction with improved closure means for selective tightening thereof for facilitating attachment about the foot of a wearer as defined in claim 1 wherein said footwear lacing means is circular in cross-sectional shape to facilitate gripping thereof by said cam cleat means of said lace securement means.

17. A footwear construction with improved closure means for selective tightening thereof for facilitating attachment about the foot of a wearer as defined in claim 1 further comprising a gripping means detachably secured to said footwear lacing means to facilitate holding thereof for tightening.

18. A footwear construction with improved closure means for selective tightening thereof for facilitating attachment about the foot of a wearer as defined in claim 17 wherein said gripping means is disc-shaped and oriented perpendicularly to said footwear lacing means to facilitate pulling thereof longitudinally.

19. A footwear construction with improved closure means for selective tightening thereof for facilitating attachment about the foot of a wearer as defined in claim 1 wherein said lacing securement means includes a clip means secured to the footwear upper means, said clip means further including two flexibly resilient side members for resiliently retaining said footwear lacing means secured extending therethrough, said two flexibly resilient side members being spatial disposed from one another and defining therebetween an open top area to facilitate gripping of said footwear lacing means within said clip means.

20. A footwear construction with improved closure means for selective tightening thereof for facilitating attachment about the foot of a wearer, said footwear means comprising:

A. a footwear sole means adapted to extend below the foot of a wearer;

B. a footwear upper means attached to said footwear sole means and extending upwardly therefrom around the foot of the wearer, said footwear upper means defining a foot opening means therein to allow entry and exit of the foot of a wearer therewithin, said footwear upper means also defining an elongated lacing gap means extending therealong and adjacent the foot opening defined therein to facilitate entry and exit of the foot of a wearer within the footwear upper means, said footwear upper means including:

(1) a first opening edge area extending along one side of said elongated lacing gap means, said first opening edge area defining a plurality of first lacing apertures therein; and (2) a second opening edge area extending along the opposite side of said elongated lacing gap means, said second opening edge area defining a plurality of second lacing apertures therealong, said first opening edge area and said second opening edge area defining said elongated lacing gap means therebetween;

C. a footwear lacing means secured to said footwear upper means along said elongated lacing gap means and extending through said first lacing apertures and said second lacing apertures for tightening thereof and for selectively securing the footwear upper means about the foot of a wearer, said footwear lacing means comprising a longitudinal lacing member including a first lacing end and a second lacing end, said footwear lacing means being circular in cross-section and being longitudinally resiliently extensible to facilitate selective securement thereof, said footwear lacing means defining a plurality of first securement slots therein adjacent said first lacing end thereof, said footwear lacing means further defining a plurality of second securement slots therein adjacent said second lacing end thereof, said first opening edge area and said second opening edge area being movable together to selectively tighten said elongated lacing gap means responsive to tightening securement of said footwear lacing means, said footwear lacing means further including a first gripping means detachably secured to said first lacing end and a second gripping means detachably secured to said second lacing end to enhance gripping thereof by a wearer;

D. a lacing securement means attached to said footwear upper means adjacent said elongated lacing gap means thereof for receiving and securing said footwear lacing means in a tightened position for retaining said elongated lacing gap means selectively retained, said lacing securement means including at least one cam cleat means including a pair of pivotal members being relatively pivotally movable and positioned adjacently and adapted to selectively grip and retain said footwear lacing means extending therebetween for selectively tightening thereof across said elongated lacing gap means to retain the footwear means about the foot of a wearer, said cam cleat means including:

(1) a first cam cleat mounted to said footwear upper means along said elongated lacing gap means for receiving said first lacing end of said longitudinal lacing member extending therethrough for selective securement therewithin;

(2) a second cam cleat mounted to said footwear upper means spatially disposed from said first cam cleat and along said elongated lacing gap means for receiving said second lacing end of said longitudinal lacing member extending therethrough for selective securement therewithin, said first cam cleat and said second cam cleat being mounted upon said footwear upper means with said elongated lacing gap means positioned therebetween to facilitate tightening thereof responsive to securement of said first lacing end with respect said first cam cleat and to securement of said second lacing end with respect to said second cam cleat; and E. a stud means for selective securement of said footwear lacing means with respect to said footwear upper means, said stud means including:

(1) a plurality of first studs fixedly secured to said footwear upper means and extending outwardly therefrom adjacent said first cam cleat and adapted to be positioned extending into said first securement slots defined in said first lacing end of said footwear lacing means positioned extending through and retained within said first cam cleat;

(2) a plurality of second studs fixedly secured to said footwear upper means and extending outwardly therefrom adjacent said second cam cleat and adapted to be positioned extending into said second securement slots defined in said second lacing end of said footwear lacing means positioned extending through and retained within said second cam cleat.

21. A footwear construction with improved closure means for selective tightening thereof for facilitating attachment about the foot of a wearer, said footwear means comprising:

A. a footwear sole means adapted to extend below the foot of a wearer;

B. a footwear upper means attached to said footwear sole means and extending upwardly therefrom around the foot of the wearer, said footwear upper means defining a foot opening means therein to allow entry and exit of the foot of a wearer therewithin, said footwear upper means also defining an elongated lacing gap means extending therealong and adjacent the foot opening defined therein to facilitate entry and exit of the foot of a wearer within the footwear upper means;

C. a footwear lacing means secured to said footwear upper means along said elongated lacing gap means for tightening thereof for selectively securing the footwear upper means about the foot of a wearer; and D. a lacing securement means attached to said footwear upper means adjacent said elongated lacing gap means thereof for receiving and securing said footwear lacing means in a tightened position for retaining said elongated lacing gap means selectively retained, said lacing securement means including at least two cam cleat means each including a pair of pivotal members being relatively pivotally movable and positioned adjacently and adapted to selectively grip and retain said footwear lacing means extending therebetween for selectively tightening thereof across said elongated lacing gap means to retain the footwear means about the foot of a wearer, each of said cam cleat members including:

(1) a cleat base means secured to said footwear upper means;

(2) a first cam member pivotally movably mounted to said cleat base means and being resiliently biased for clockwise rotation thereof with respect to said cleat base means, said first cam member including a first camming surface adapted to abut and engage said footwear lacing means;

(3) a second cam member pivotally movably mounted to said cleat base means and being resiliently biased for counter-clockwise rotation thereof with respect to said cleat base means, said second cam member including a second camming surface adapted to abut and engage said footwear lacing means, said second cam member being positioned adjacent said first cam member with said first camming surface and said second camming surface defining a lacing receiving slot therebetween adapted to receive said footwear lacing means for selective securement therewithin; and (4) a guide ring means positioned adjacent said lacing receiving slot defined therein to facilitate guiding and retaining of said footwear lacing means therein for securement thereof by said first camming surface and said second camming surface.

* * * * *